US005611980A

United States Patent [19]

Eto et al.

[11] Patent Number: 5,611,980

[45] Date of Patent: Mar. 18, 1997

[54] APPARATUS AND METHOD FOR SLIP CASTING

[75] Inventors: Mamoru Eto; Masaharu Yasui; Hidetoshi Ohtani; Taiichi Aso, all of Kitakyushu, Japan

[73] Assignee: Toto Ltd., Fukuoka-ken, Japan

[21] Appl. No.: 464,419

[22] Filed: Jun. 5, 1995

[30] Foreign Application Priority Data

Jun. 8, 1994 [JP] Japan ..... 6-126352

[51] Int. Cl.[6] ..... B28B 1/26

[52] U.S. Cl. ..... 264/87; 425/85

[58] Field of Search ..... 264/86, 87; 425/84, 425/85

[56] References Cited

U.S. PATENT DOCUMENTS

| | | | |
|---|---|---|---|
| 4,528,152 | 7/1985 | Aoyama et al. | 264/87 |
| 4,591,472 | 5/1986 | Gerster | 264/87 |
| 4,664,610 | 5/1987 | Aoyama et al. | 425/85 X |
| 4,832,890 | 5/1989 | Sato et al. | 264/87 |
| 4,882,111 | 11/1989 | Murata | 264/87 |
| 4,948,087 | 8/1990 | Hisaeda et al. | 264/86 X |
| 5,083,911 | 1/1992 | Hisaeda et al. | 425/84 |
| 5,120,211 | 6/1992 | Ito et al. | 264/86 X |
| 5,156,855 | 10/1992 | Hisatomi et al. | 425/84 |
| 5,427,722 | 6/1995 | Fouts et al. | 264/87 |

FOREIGN PATENT DOCUMENTS

| | | | |
|---|---|---|---|
| 211653 | 2/1987 | European Pat. Off. | 264/87 |

*Primary Examiner*—Karen Aftergut

[57] ABSTRACT

An apparatus for slip casting includes a pouring pipe for supplying slip, to which each mold is connected by way of a pouring hose having a pouring valve. A slip discharge pipe is provided in the vicinity of the pouring pipe. The pouring pipe and the slip discharge pipe are connected by a by-pass pipe which includes a rising pipe, a traverse pipe, a connecting pipe and an atmosphere pipe. Slip is fed from the pouring pipe to each mold. After a body is formed with a predetermined thickness in each mold 1, pressurized air is fed to the slip discharge spaces to discharge surplus slip to the slip discharge pipe. The height of the rising pipe is set so that the pressure of discharging the surplus slip and the head pressure of the slip within the rising pipe balance each other when the surplus slip is discharged to the slip discharge pipe. This allows the pressure within the slip discharge spaces to be stabilized.

8 Claims, 4 Drawing Sheets

APPARATUS AND METHOD FOR SLIP CASTING

FIELD OF THE INVENTION

This invention relates to an apparatus and a method for casting a piece of sanitary ceramic ware, such as a toilet bowl, a urinal or the like with slip, while discharging undeposited slip and, more particularly, to an apparatus and a method for slip casting, which makes it possible to prevent a formed body from leaving the inner surface of the mold.

BACKGROUND OF THE INVENTION

In general, a piece of sanitary ceramic ware product is produced by a method of slip casting using a plaster mold having a property of absorbing water, however, the number of casting operations per day is limited to two or three times because of the characteristics of plaster and, moreover, one or two hours are required for each molding cycle. From this reason, a method is usually adopted in which slip is cast in a number of molds simultaneously to increase the number of product moldings per cycle, thereby improving the productivity.

FIG. 5 shows such a kind of conventional forming apparatus in which reference character 1 indicates a number of molds arranged in a row. Each mold 1 is connected to a common pouring pipe 2 through a pouring hose 3, and the pouring pipe 2 is provided at one end thereof with a head tank 4 for supplying slip and at the other end with a tank 5 for discharging slip.

In the operation of the construction as described above, slip is supplied from a slip supply pipe 6 with a slip replenishing valve 7 to the head tank 4 for a pouring operation. With a slip discharge valve 8 being closed, a slip supply valve 9 and the pouring valves 10 are opened to thereby supply slip to the molds 1 by way of a downward pipe 11, pouring pipe 2 and pouring hoses 3.

After completion of the slip depositing process, the slip supply valve 9 is closed and each pressurized air hose 12 for the discharge of slip is inserted into a through-hole 13 at the top of each mold. Using a pressurized air valve 14 for slip discharge, pressurized air for slip discharge from a source of pressurized air 15 is supplied to the molds by way of an air pipe 16 for slip discharge and the pressurized air hoses 12 for slip discharge and, thereafter, the slip discharge valve 8 is opened so that undeposited slip within the molds 1 are discharged to the tank 5 by way of the pouring hoses 3 and both valves 8 and 10.

In this connection, in the through-hole 13 at the top of each mold is mounted a gas permeable screen (not shown) which enables the flow of slip to be cut off, so that slip does not flow out from the through-hole 13 on the top of each mold 1 when slip is being poured therein.

With the above-described conventional molding system, a formed body immediately after slip discharge has a high water content of 20–30% and is apt to be deformed. For this reason, a hardening process is carried out which comprises subsequently feeding compressed air into the slip discharge space of the formed body for a predetermined period of time to cause the moisture in the formed body to be removed toward the plaster mold by a pressure of compressed air, thereby lowering a water content of the molded body to raise the strength thereof.

In the meantime, the formed body within the plaster mold begins to shrink after completion of the depositing operation of slip, causing a disengagement from the mold (a phenomenon of the formed body disengaging from the mold), and when such a disengagement from the mold occurs once, the formed body does not raise the strength and cannot be removed from the molds. This requires the formed body to be kept in close contact with the inner surface of the plaster mold by always applying a pressure of air to the slip discharge space of the mold at the time of slip discharge and during the subsequent hardening process so as not to cause the disengagement from the mold.

Hereupon, since in the conventional molding apparatus the interiors of the pouring pipe 2 and the pouring hoses 3 are filled with slip at the beginning of slip discharge, a resistance of the pipe line at the time of slip discharge is relatively stable and a pressure in the slip discharge space of each formed body is also stable.

However, at the end of slip discharge, the condition exists in the interior of the pouring pipe 2 of air and slip being mixed, as shown in FIG. 6, and air for slip discharge escapes from the upper space of the pouring pipe 2; so, violent fluctuation in the resistance of the pipe line occurs, thereby resulting in a fluctuation of the pressure in the slip discharge space 18 within the formed body 17. For this reason, there is a danger of the formed body 17 repeating a motion of disengaging from the mold and engaging the inner surface of the mold until the formed body 17 is cracked. Further, there is a problem in that a water content of the formed body 17 is not lowered, is apt to become deformed when removed from the mold, and the quality of the product is unstable.

Moreover, the pouring pipe 2 needs to be inclined in a down-grade toward the tank 5 in order to cause slip to flow down to the tank 5 at the end of the pouring pipe 2; however, in the case where the number of the molds 1 is high, an inclination angle of the pouring pipe 2 becomes small if a level of the tank 5 is not changed, so, slip does not flow well and a long time is spent discharging slip. Further, if the inclination angles are always made equal, it is necessary to change the level of the tank 5 each time.

In order to shorten a time required for slip discharge, it has been considered to provide a pump at the discharge side of the pouring pipe 2 to promote the discharge of slip by a force of suction of the pump; however, it is difficult to balance the force of suction of the pump with the pressure and amount of pressurized air for slip discharge supplied to the slip discharge space 18, and the interior of the slip discharge space 18 is apt to possess a negative pressure. As a result, there is a danger of the molded body 17 becoming deformed within the mold 1.

SUMMARY OF THE INVENTION

Accordingly, it is an object of the invention to provide an apparatus and a method for slip casting, which allows the pressure of pressurized air supplied to the interiors of the slip discharge spaces of the formed bodies to be kept stable in a slip discharge process and a hardening process, thereby preventing the disengagement of the formed bodies from the molds, and so stabilizing the quality of the formed bodies, and which allows a time required for slip discharge to be shortened.

In order to achieve the above-described object of the invention, according to the invention, there is provided an apparatus for slip casting, which comprises:

one or more slip casting molds;

a pouring pipe for supplying slip and arranged below said slip casting molds;

one or more branch pipes which branch off from said pouring pipe and which each are connected to the slip supply and discharge port at the lower end of each of said slip casting molds;

means for feeding pressurized air into the slip discharge spaces of the formed bodies within said slip casting molds; and a rising pipe which rises from said pouring pipe and which serves to discharge said slip from said slip casting molds to a slip delivery port of said rising pipe, said rising pipe being set so that the head pressure of the slip therein is substantially balanced with the pressure of the slip which is pushed out from said discharge spaces by said pressurized air from said pressurized air feeding means.

The apparatus for slip casting further includes a slip discharge pipe at said slip delivery opening of said rising pipe, which is provided with a discharge pump and an atmosphere suction regulating valve.

Moreover, a method for slip casting, wherein said slip casting system is used which comprises:

one or more slip casting molds;

a pouring pipe for supplying slip and arranged below said slip casting molds;

one or more branch pipes which branch off from said pouring pipe and which each are connected to the slip supply and discharge port at the lower end of each of said slip casting molds;

means for feeding pressurized air into the slip discharge spaces of the formed bodies within said slip casting molds; and a rising pipe which rises from said pouring pipe and which serves to discharge said slip from said slip casting molds to a slip delivery port of said rising pipe, said rising pipe being set so that the head pressure of the slip therein is substantially balanced with the pressure of the slip which is pushed out from said discharge spaces by said pressurized air from said pressurized air feeding means, whereby said slip within said slip casting molds is pressed out into said slip discharge pipe by way of said pouring pipe and said rising pipe by the pressurized air supplied into said slip discharge spaces of said formed bodies and, simultaneously, said slip within said slip discharge pipe is discharged by a suction force of said discharge pump to regulate the amount of the atmosphere sucked therein by controlling the atmosphere suction regulating valve to a predetermined opening of degree so that the suction force of said pump may not affect the pouring pipe and the rising pipe.

In the operation of the slip casting apparatus according to the present invention, pressurized air is supplied into the slip discharge spaces to thereby discharge the slip within the slip casting molds by way of the pouring pipe and the rising pipe. Thus, the pressure of the pressurized air communicating with atmosphere never occurs, thereby making it possible to stabilize the pressure within the slip discharge spaces. In addition, since the height of the rising pipe is set so that the head pressure of the slip therein is substantially balanced with the pressure of slip which is pushed out from the slip discharge spaces by pressurized air, the pressure within the slip discharge spaces is always stable during a slip discharge process and a hardening process, and a disengagement of the formed bodies from the molds does not occur, thereby making it possible to stabilize the qualities of the formed bodies.

In addition, since a slip discharge pipe having a slip discharge pump and an atmosphere suction regulating valve is provided at the slip discharge port of the rising pipe, the pressure within the slip discharge spaces of the formed bodies is made stable, while making it possible to shorten a time required for slip discharge.

DETAILED DESCRIPTION OF THE EMBODIMENT

Now, an embodiment of the present invention will be described with reference to the drawings.

Figure 1:
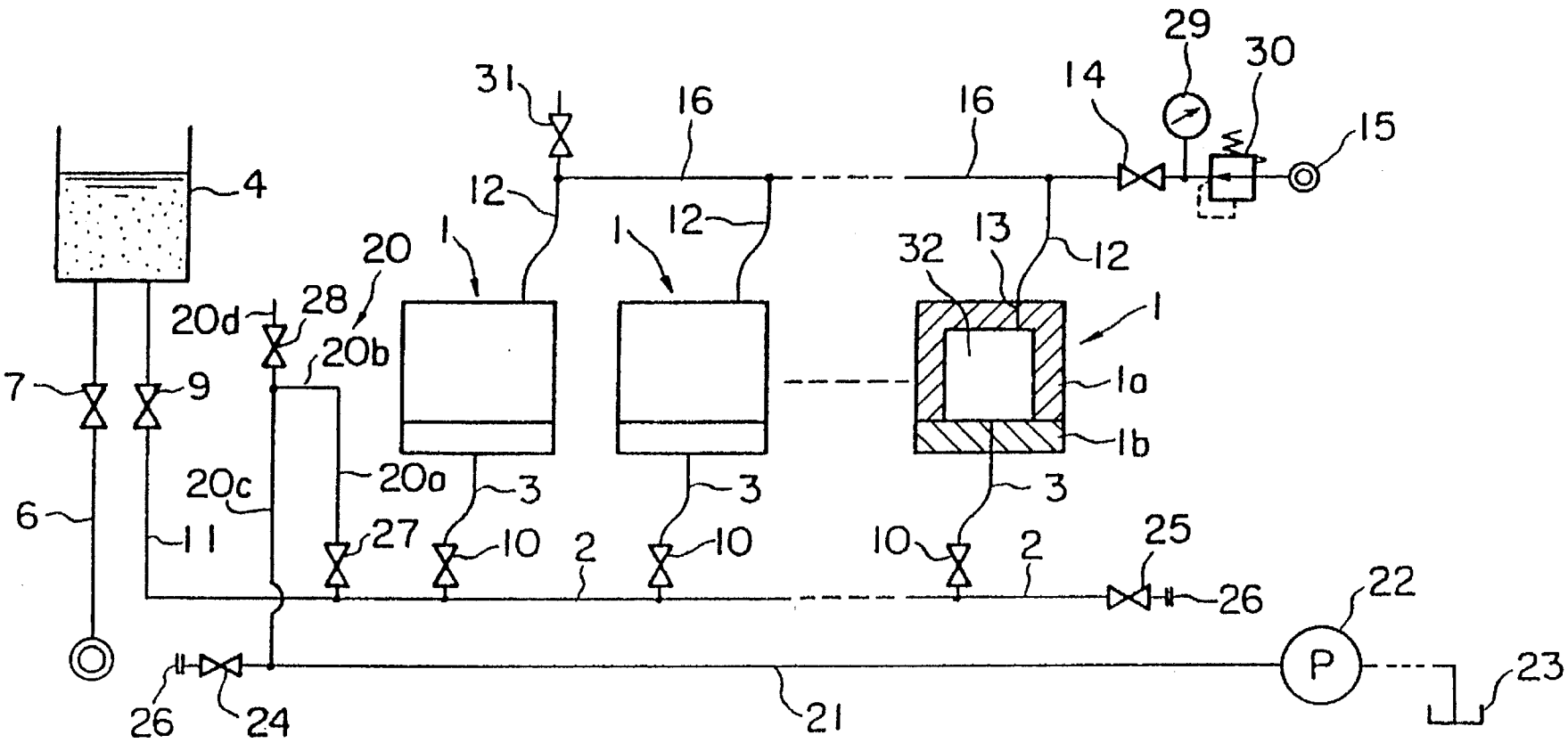
FIG. 1 is a view of composition showing an apparatus for slip casting according to the invention.

FIG. 1 shows an apparatus for slip casting according to a first embodiment of the present invention. In the drawing, reference character 1 indicates molds each composed of an upper mold la and a lower mold 1*b*, a large number of which are arranged side by side and a common pouring pipe 2 is horizontally arranged below the molds 1. The pouring pipe 2 and each mold 1 are connected through a pouring hose 3 having a pouring valve 10.

The pouring pipe 2 is connected at one end thereof to a head tank 4 by way of a rising pipe 11 having a slip supply valve 9. The head tank 4 is automatically replenished with slip by way of a slip supply pipe 6 having a slip replenishing valve 7, so that the head pressure of slip supplied from the head tank 4 to the molds 1 is always maintained at a constant level.

At an intermediate position between the rising pipe 11 of the pouring pipe 2 and the pouring hose 3 is connected a slip discharge pipe 21 by way of a by-pass pipe 20, and along the slip discharge pipe 21 is provided a slip discharge pump 22, which is connected at a delivery side thereof to a slip tank 23 provided in a preparation process in order to store and control the slip discharged from the molds 1. The end of the slip discharge pipe 21 and the end of the pouring pipe 2 each are cut off by a slip discharge end valve 24, a pouring pipe end valve 25 and a flange 26. The interior of each of the pipes 21 and 2 can be cleaned by removing the flange 26 and opening each of the pipe end valves 24 and 25.

Figure 2:
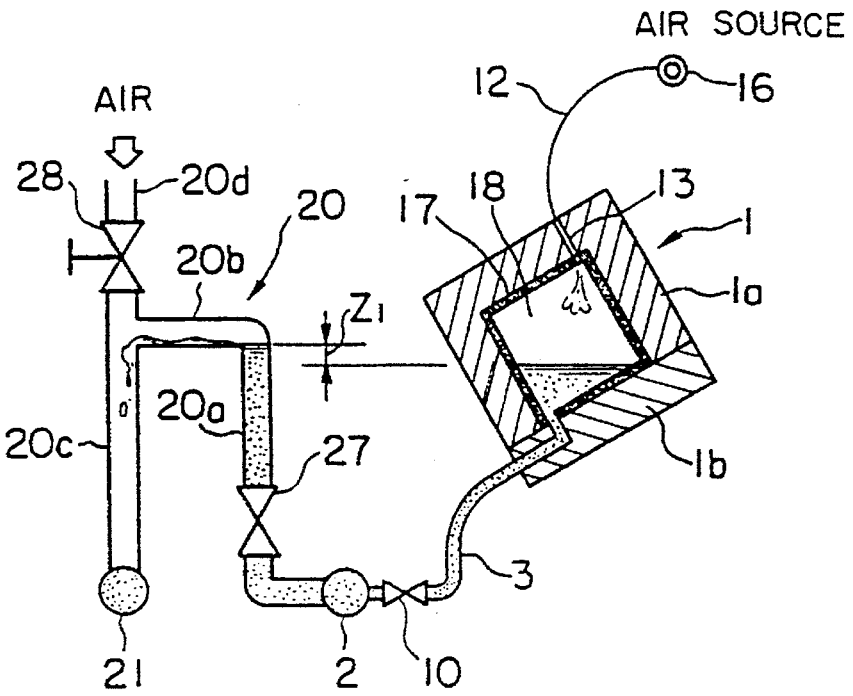
FIG. 2 is an explanative view showing a relation between a pressure head at a slip feeding side and a position head at a slip discharge side at the beginning of slip discharge.
Figure 3:
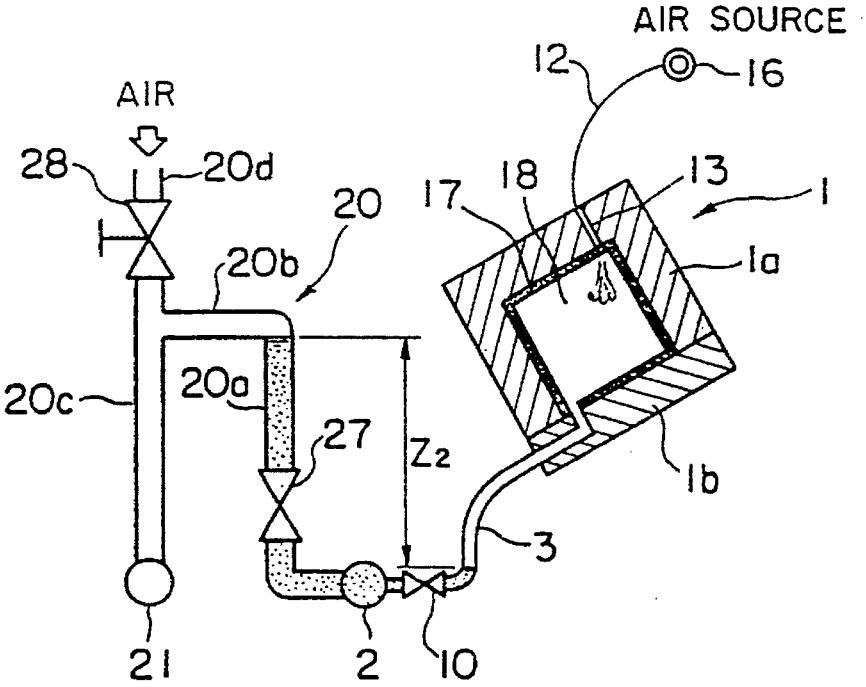
FIG. 3 is an explanative view showing a relation similar to FIG. 2 at the end of slip discharge.

As shown in FIGS. 2 and 3, the by-pass pipe 20 comprises a rising pipe 20*a* which is connected at the lower end thereof to the pouring pipe 2 by way of a by-pass valve 27, a traverse pipe 20*b* connected to the upper end of the rising pipe 20*a*, a connecting pipe 20*c* which falls from the end of the traverse pipe 20*b* and which is connected at the lower end thereof to the slip discharge pipe 21, and an atmosphere pipe 20*d* which rises from the end of the traverse pipe 20*b* and which is provided with an atmosphere suction regulating valve 28.

An air pipe 16 for slip discharge is arranged at a position above each mold 1, and pressurized air hoses 12 for slip discharge which branch off from the air pipe 16 for slip discharge are connected to a through-hole 13 at the top of each mold 1. A gas permeable screen (not shown), which enables slip to be cut off, is mounted on the through-hole 13 at the top of each mold 1.

A upstream side of the air pipe 16 for slip discharge is connected to a source of pressurized air 15 by way of a pressurized air valve 14 for slip discharge, a pressure gauge 29 and a precise pressure-reducing valve 30. The end of the air pipe 16 for slip discharge is opened to the atmosphere by way of an atmosphere opening valve 31.

The operation of the present embodiment will be described.

Slip is supplied to the molds 1 under the head pressure of the head tank 4 for a forming operation. The head tank 4 is provided with a device for detecting a level of slip (not shown), which functions to automatically open the slip replenishing valve 7 when the level of slip drops, thereby replenishing slip from the slip supply pipe 6 to the head tank 4, so that the pressure of slip supplied from the head tank 4 to the molds is controlled to be always at a constant level.

Pouring is performed in the following procedure. Namely, with the by-pass valve 27 and the pressurized air valve 14 for slip discharge being closed and the atmosphere opening valve 31 being open, the slip supply valve 9 and the pouring valves 10 are opened to supply the slip within the head tank 4 to the molds 1 through the rising pipe 11, pouring pipe 2 and pouring hoses 3.

As the molds are filled with slip, air within the cavities 32 is discharged from the through-holes 13 at the top of the molds to the outside by way of the pressurized air hoses 12 for slip discharge and the air pipe 16 for slip discharge, so that air within the molds is displaced by slip.

After the molds have been filled with slip, the apparatus is maintained with the head pressure of slip within the head tank 4 being applied to the slip within the molds 1, i.e., with the slip supply valve 9 and the pouring valves 10 being open and the by-pass valve 27 being closed, and the apparatus is left for a predetermined period of time, thereby allowing formed bodies 17 to be formed within the molds.

After a predetermined time has lapsed and each formed body 17 having a predetermined thickness has been formed, the slip supply valve 9 is closed with the pouring valves 10 being opened, thereby cutting off the head pressure from the head tank 4. Then, the atmosphere opening valve 31 is closed and the pressurized air valve 14 for slip discharge is opened, thereby supplying pressurized air for slip discharge from the through-holes 13 at the top of the molds to the interiors of the molds 1 by way of the pressurized air pipe 16 for slip discharge and the pressurized air holes 12 for slip discharge.

Thereafter, the by-pass valve 27 is opened to discharge the surplus slip within the molds 1 into the pouring pipe 2 once and, subsequently, feed it under pressure to the slip discharge pipe 21 through the by-pass pipe 20 by the pressure of the pressurized air for slip discharge. The slip which has been fed into the slip discharge pipe 21 is further fed to the slip tank 23 by the slip discharge pump 22.

Hereupon, if a pressure of the pressurized air for slip discharge is denoted by P(pa), a density of slip $\rho$ (kg/m$^3$), acceleration of gravity g (9.8 m/s$^2$) and the height of the by-pass pipe Z (m), the first feature of the present invention lies in that in the discharge of surplus slip from the mold 1 (slip discharge), the height of the rising pipe 20*a* is set so that the pressure head ($P/\rho g$) at the slip feeding side and the position head (Z) at the discharge side substantially balance each other.

Namely, since the position head $z_1$ at the discharge side is small at the beginning of slip discharge, as shown in FIG. 2, the surplus slip flows over the rising pipe 20*a* and is discharged to the slip discharge pipe 21 by way of the traverse pipe 20*b* and the connecting pipe 20*c*.

When a level of the surplus slip within the mold 1 drops and, as shown in FIG. 3, a level of the slip within the pouring hose 3 comes to be a level immediately before the pressurized air for slip discharge flows into the pouring valve 10, so that the position head at the discharge side reaches the designed dimension of $Z_2$, and then the pressure of the pressurized air for slip discharge and the head pressure of slip in the rising pipe 20*a* balance with each other, resulting in that the flow of slip stops and the slip discharge is completed.

Further, a loss of head (h) due to a resistance of the pipe line at the discharge side has no direct relation with the set of the height of the rising pipe 20*a;* however, as the resistance of the pipe line becomes greater, a velocity of flow becomes slower, so, the time required for slip discharge becomes longer.

The second feature of the present invention lies in that an atmosphere suction regulating valve 28 is provided in an atmosphere pipe 20*d* of the by-pass pipe 20.

Namely, the atmosphere pipe 20*d* is provided with the atmosphere suction regulating valve 28, and by the control of a degree of opening the valve 28, an amount of suction of air is regulated so that a force of suction of the slip discharge pump 22 exerts no influence on the slip within the pouring pipe 2 and the molds 1 and, simultaneously, while the interior of the slip discharge pipe 21 is kept in a negative pressure by the suction of the slip discharge pump 22, the slip within the slip discharge pipe 21 is fed to the slip tank 23 under pressure.

After the slip discharge process is finished in this way, the pouring valves 10 are closed and, subsequently, a hardening process is carried out by feeding pressurized air for slip discharge to the slip discharge spaces 18 to lower the water content of the formed bodies 17, while preventing the formed bodies from disengaging from the inner surface of the molds 1.

In this way, the pressurized air for slip discharge supplied to the slip discharge spaces 18 communicating with the atmosphere never occurs during the slip discharge process and the hardening process, and the height of the rising pipe 20*a* is set so that the pressure head ($p/\rho g$) at the slip feeding side and the position head (Z) at the discharge side substantially balance with each other; so, the pressure within the slip discharge spaces 18 can be stabilized. For this reason, a disengagement of the formed bodies from the molds does not occur, thereby allowing the qualities of the formed bodies 17 to be stabilized.

Moreover, since when the slip within the slip discharge pipe 21 is discharged by the slip discharge pump 22, atmosphere is sucked while a degree of opening the atmosphere suction regulating valve 28 being adjusted, the pressure in the slip discharge space 18 is stabilized and, simultaneously, a time required for discharge of slip can be shortened.

Figure 4:
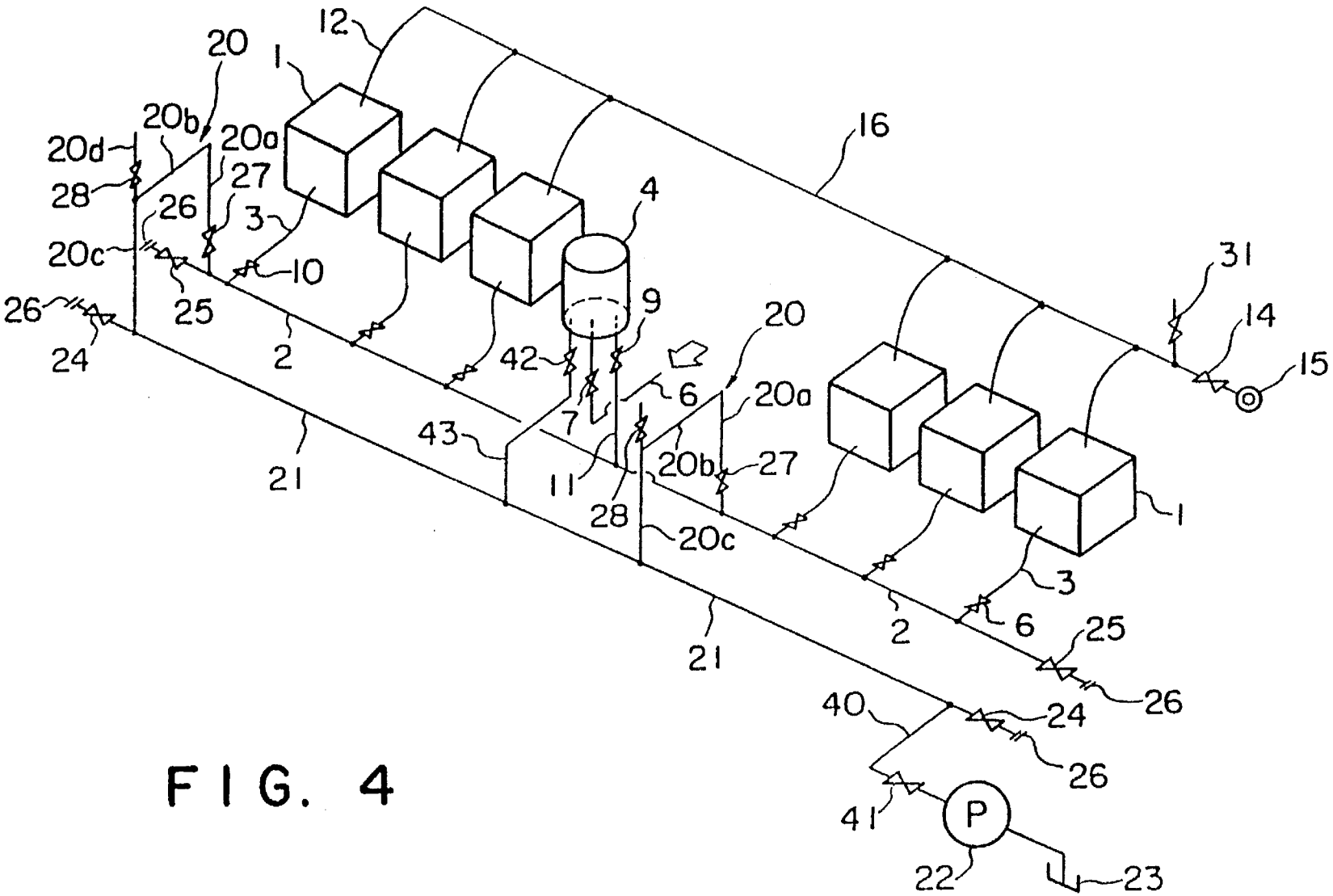
FIG. 4 is a perspective view showing an apparatus for slip casting according to a second embodiment.
Figure 5:
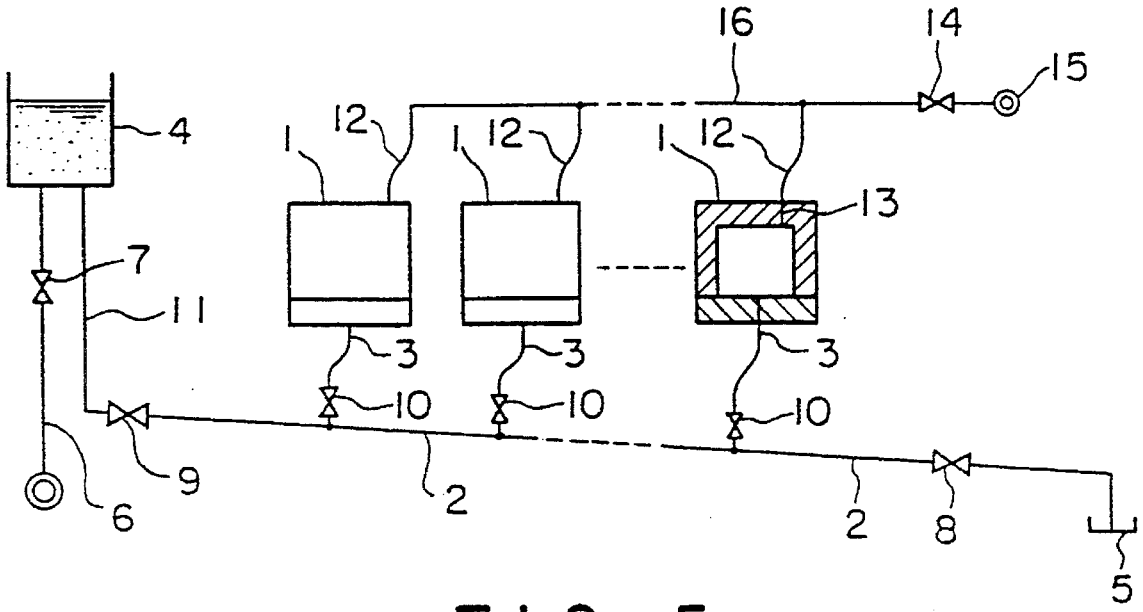
FIG. 5 PRIOR ART
FIG. 5 is a view of composition showing a conventional apparatus for slip casting.
Figure 6:
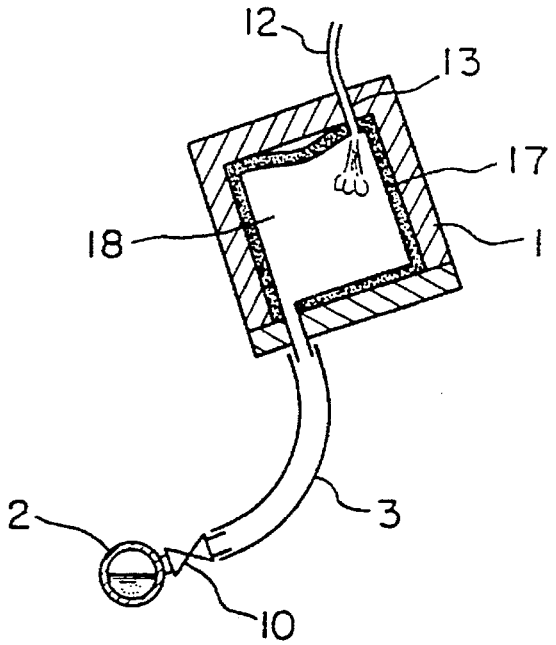
FIG. 6 PRIOR ART
FIG. 6 is an explanative view showing a problem in the conventional apparatus.

FIG. 4 shows a second embodiment of the present invention, a pipe arrangement of which allows the number of the molds 1 to be easily increased and decreased.

Namely, a head tank 4 is connected to an intermediate part of a pouring pipe 2 by way of a rising pipe 11, and the pouring pipe 2 and a slip discharge pipe 21 parallel thereto are provided at their both ends with a pouring end valve 25, a slip discharge end valve 24 and a flange 26, respectively. Further, a slip discharge pump 22 is provided in a branch pipe 40 which branches off from one end side of the slip discharge pipe 21, and a slip discharge pump inlet valve 41 is provided at the inlet side of the slip discharge pump 22. Moreover, the head tank 4 is connected to the slip discharge pipe 21 by way of a slip removing pipe 43 having a slip removing valve 42. Between the pouring pipe 2 and the slip discharge pipe 21 are provided, for example, two by-pass valves 20.

The other construction of this embodiment is the same as in the above-described first embodiment, and the operation thereof is also the same.

In this way, the plurality of by-pass valves 20 are provided and the pouring pipe 2 and the slip discharge pipe 21 are closed at both ends thereof by flanges 26; so, if these flanges 26 are removed and the pipe arrangements similar to FIG. 4 are continuously provided, the number of the molds 1 can be easily increased and also the increased molds 1 can be easily decreased.

As described above, since in the slip casting apparatus according to the invention pressurized air is fed into the slip discharge spaces to thereby discharge the slip within the slip casting molds by way of the pouring pipe and the rising pipe, and since the height of the rising pipe is set so that the head pressure of the slip is substantially balanced with the pressure of the slip which is pushed out from the slip discharge spaces by pressurized air, the pressurized air communicating with atmosphere never occurs, and the pressure within the slip discharge spaces can be always stabilized during a hardening process and a discharging process. For this reason, a disengagement of the formed bodies from the inner surface of the molds never occurs, thereby allowing the qualities of the formed bodies to be stabilized.

Further, the rising pipe is provided at the slip delivery port thereof with the discharge pump and the slip discharge pipe having an atmosphere suction regulating valve; so, when the slip within the slip discharge pipe is sucked and discharged by the discharge pump, a degree of opening the atmosphere suction regulating valve is regulated to thereby stabilize the pressure within the slip discharge spaces of the formed bodies and, simultaneously, to shorten a time required for discharge of slip. Moreover, in a slip casting according to the present invention, the slip within the slip casting formed is pushed out into the slip discharge pipe through the pouring pipe and the rising pipe by the pressurized air supplied into the slip discharge spaces of the formed bodies and, simultaneously, while a degree of opening the atmosphere suction regulating valve is regulated to suck atmosphere, the slip within the slip discharge pipe is discharged by a force of suction of the discharge pump; so, the pressure within the slip discharge spaces of the molded bodies is stabilized to thereby make the qualities of the formed bodies stable, and a time required for discharge of slip can be shortened.

What is claimed is:

1. An apparatus for slip casting formed bodies, which comprises:

one or more slip casting molds;

a pouring pipe for supplying slip and arranged below said slip casting molds;

one or more branch pipes which branch off from said pouring pipe and which each are connected to a slip supply and discharge port at a lower end of each of said slip casting molds;

means for feeding pressurized air into slip discharge spaces of formed bodies cast within said slip casting molds; and pipe means which includes a first portion rising from said pouring pipe for discharging said slip from said slip casting molds to a slip delivery port located at a second portion of said pipe means, said pipe means including meads for substantially balancing head pressure of slip within said pipe means with a pressure of slip which is pushed out from said slip discharge spaces by said pressurized air fed from said means for feeding pressurized air, so that disengagement of said formed bodies in said slip casting molds does not occur during said discharging of said slip.

2. The apparatus for slip casting as claimed in claim 1, further including a slip discharge pipe located at said slip delivery port of said pipe means, said slip discharge pipe having a discharge pump and said pipe means including an atmosphere suction regulating valve.

3. A method for slip casting formed bodies wherein a slip casting system is used which comprises:

one or more slip casting molds;

a pouring pipe for supplying slip and arranged below said slip casting molds;

one or more branch pipes which branch off from said pouring pipe and which each are connected to a slip supply and discharge port at a lower end of each of said slip casting molds;

means for feeding pressurized air into slip discharge spaces of formed bodies cast within said slip casting molds; and pipe means which includes a first portion rising from said pouring pipe for discharging said slip from said slip casting molds to a slip delivery port located at a second portion of said pipe means, said pipe means including means for substantially balancing head pressure of slip within said pipe means with a pressure of slip which is pushed out from said slip discharge spaces by said pressurized air from said means for feeding pressurized air, said method including the steps of:

(a) pouring and filling said slip casting molds with slip and allowing a predetermined amount of said slip to form slip cast bodies;

(b) discharging slip from said slip casting molds by said pressurized air fed to slip discharge spaces of said formed bodies;

(c) directing said discharged slip to said pipe means by way of said pouring pipe;

(d) directing said discharged slip from said pipe means to a slip discharge pipe located at said slip delivery port of said pipe means; and (e) discharging said slip from said slip discharge pipe by suction force of a discharge pump, whereby disengagement of said bodies formed in said slipcasting molds does not occur.

4. The method of claim 3, further including the steps of (f) controlling a degree of opening of an atmosphere regulating valve operatively connected to said pipe means so that said suction force of said discharge pump exerts no influence on said slip in said pouring pipe or slipcasting molds.

5. The apparatus of claim 1, wherein said pipe means includes a third portion connecting said first and second portions.

6. The apparatus of claim 5, wherein said pipe means includes an atmospheric pipe including an atmospheric suction regulating valve.

7. The apparatus as claimed in claim 1, wherein said pouring pipe includes a pouring end valve and flange at each end.

8. The apparatus as claimed in claim 7, including a slip discharge pipe located adjacent to said pouring pipe, said slip discharge pipe including an end valve and flange at each end.

* * * * *